United States Patent [19]

Wang

[11] 4,294,550

[45] Oct. 13, 1981

[54] IDEOGRAPHIC TYPEWRITER

[75] Inventor: An Wang, Lincoln, Mass.

[73] Assignee: Wang Laboratories, Inc., Lowell, Mass.

[21] Appl. No.: 129,074

[22] Filed: Mar. 10, 1980

[51] Int. Cl.[3] ..... B41J 5/00; B41J 5/44

[52] U.S. Cl. ..... 400/110; 365/127; 400/73

[58] Field of Search ..... 400/61, 70, 73, 83, 400/109, 110; 364/518, 519, 520; 365/120, 127

[56] References Cited

U.S. PATENT DOCUMENTS

| | | | |
|---|---|---|---|
| 2,950,800 | 8/1980 | Caldwell | 400/110 |
| 3,229,047 | 1/1966 | Simpson | 365/127 X |
| 3,252,143 | 5/1966 | Sundblad | 365/127 X |
| 3,319,516 | 5/1967 | Brown | 400/110 X |
| 3,325,786 | 6/1967 | Shashoua et al. | 400/110 X |
| 3,408,634 | 10/1968 | Lee et al. | 365/127 |
| 3,509,543 | 4/1970 | Lee et al. | 365/127 |

FOREIGN PATENT DOCUMENTS

| | | | |
|---|---|---|---|
| 2018868 | 11/1971 | Fed. Rep. of Germany | 400/110 |
| 1439274 | 6/1976 | United Kingdom | 400/110 |

*Primary Examiner*—Paul T. Sewell

[57] ABSTRACT

A Chinese typewriter comprising a keyboard for the input of numerical and command signals, a control circuit for control of the system, a rotating drum carrying a film strip on which are optically stored a plurality of Chinese characters, a CRT display for verifying the desired character, and a printer.

1 Claim, 3 Drawing Figures

IDEOGRAPHIC TYPEWRITER

The invention relates to apparatus for use as a typewriter for ideographic characters.

The basic problem in providing a typewriter for an ideographic written language such as Chinese has been that an ideograph is not alphabetic. Such a language is not written in words comprising letters selected from an alphabet containing only a small number of letters, but is written in ideographs, each ideograph representing a word. There are thousands of such ideographs. Therefore, in contrast with a typewriter for an alphabetically written language, which requires only enough keys and type elements to select and represent the letters of the alphabet, with the addition of diacritical marks in certain languages, a typewriter for an ideographically written language requires means to select and to print each possible ideograph.

For example, a basic Chinese vocabulary might include four thousand characters, which is sufficient to read an average newspaper. Technical literature may require from eight thousand to twelve thousand characters. A scholar would be familiar with many more characters. A modern dictionary such as those used in high schools and colleges contains between 10,000 and 15,000 Chinese characters.

The great number of characters required for writing Chinese has caused great difficulties in providing a Chinese typewriter. The difficulties are associated with both selection and printing, since if a single print element is provided for each character, and a single key is provided to select that print element, the structure must be extremely large; furthermore only the most exceptional operator can remember the positions of keys to select even a portion of the necessary characters. To avoid these problems, in some machines, compromises have been made, in limiting the number of characters available. Even with such limitations, the typewriters or printers have been large, cumbersome, and expensive, and in addition have required lengthy training to operate. Even trained operators only achieve typical operating speeds of about twenty to thirty characters per minute. In contrast, a typical typing speed with an alphabetic typewriter is about sixty English words per minute.

An example of the mechanical complexity of the printing portion of prior art Chinese typewriters is the machine disclosed in U.S. Pat. No. 2,613,795, which provides a printing cylinder having thirty six type bars arranged in six units of six type bars each. Each type bar provides eight rows of type. Each row of type may contain twenty-nine characters, so that the entire printing cylinder can provide 8,352 characters. In operation, the printing cylinder must be rotated to bring one of the six type bar units into typing position, after which the type bar unit must be rotated to bring the desired type bar into printing position, and the selected type bar is then rotated to bring a desired character row into printing position. The paper carriage must then be moved to the desired character. Such a machine must necessarily be large and expensive, and the equivalent of a portable typewriter cannot be provided.

Attempted solutions to these problems have generally been directed either toward providing coded selection systems, by which any of five to ten thousand ideographs can be selected by means of a small number of digits, or toward providing a small number of print elements out of which any ideograph can be composed by multiple typing strokes.

U.S. Pat. No. 2,526,633 is an example of an attempt to reduce the number of print elements needed, by reducing all ideographs to a combination of forty simple type elements. In this case, however, each ideographic character requires on the order of thirty or forty separate typing actions to build up the ideograph out of the fundamental type elements. Such a method is time-consuming and offers multiple opportunities for error in printing each character.

Attempts to simplify the selection of the characters to be printed, by assigning numerical codes to them, have in general been based either upon traditional schemes of analyzing and classifying Chinese characters, such as are used in Chinese dictionaries, or upon the arbitrary assignment of numerical codes to the characters, as in the Chinese Telegraph code. The first approach requires considerable knowledge on the part of the operator, who must be able to recognize which portion of the character is the radical, and which portion is the phonetic, even though the relative positions of these portions are not uniform in all characters. The second approach requires an enormous feat of memory, in learning the arbitrary numerical code for each of five to ten thousand characters.

It is therefore an object of the present invention to provide a typewriter for Chinese characters (or other ideographic characters) that is mechanically simple, that can be made relatively inexpensively, and that is relatively small, compact and light weight. It is a further object of the invention to provide such a typewriter that can be operated after a relatively short training period, and without knowledge of the Chinese language or of the origin and meaning of the ideographs. It is also an object to provide a Chinese typewriter that can be operated at speeds comparable to those at which alphabetic typewriters are operated.

The typewriter of the present invention makes use of the "three-corner" coding system, developed by Li-ren Hu, Yuan-wei Chang, and Jack Kai-tung Huang of Taipei, Taiwan. This method of coding Chinese characters is based upon an analysis of the character regarded simply as a pattern. Other aspects of the character, such as its meaning, its derivation, the number of strokes required to write it, or its divisibility into component parts such as radical and phonetic, are ignored. A set of ninety-nine major fundamental pattern elements has been defined, with a further set of 201 related minor pattern elements. Each of the major pattern elements has been assigned a two-digit number from 01 to 99. The same two-digit number corresponds to from one to five related minor pattern elements. The fundamental pattern elements do not necessarily have any meaning or any independent existence apart from this system of coding characters. The numbers are not assigned arbitrarily; rather, for example, all numbers of which the first digit is "6" correspond to pattern elements which have in common a particular feature, specifically a rectangle, while all numbers of which the first digit is "4" correspond of pattern elements derived from a "+". This is an aid to learning the digits for the ninety-nine basic elements.

By following a number of formal rules, which determine the manner in which the character pattern is dissected into its components, the operator inspects a character and assigns an ordered sequence of three two-digit numbers to represent the character. An ordered sequence of three two-digit numbers in most cases uniquely defines one character. In certain cases two or more characters correspond to a particular ordered sequence, but this is uncommon.

According to the invention, an ideographic typewriter comprises a keyboard providing keys for generating numerical signals representative of numerical values corresponding to an ideographic character, and command signals representative of operational commands. The typewriter further comprises control means connected to the keyboard for receiving the signals. The control means includes decoding means responsive to the command signals for deriving control signals, conversion means for converting numerical signals corresponding to a character to signals representative of first and second position parameters, means for deriving from the second position parameter signal element selection signals, and comparator means for comparing the first position parameter signal with an input first position signal, and for deriving therefrom timing signals.

A rotating optical storage device has stored visual representations of characters. Each visual representation of a character comprises character portions and background portions of contrasting light transmission characteristics. Each character representation has first and second position parameters defining its location on the optical storage device, the first position parameter being related to the rotational position of the device. The optical storage device provides to the control means a signal representative of its rotational position.

A light source directs light through at least a group of visual representations having a common value of the first position parameter. A scanner is disposed to receive light from an opposed group of visual representations having a common value of the first position parameter. The scanner comprises a plurality of light-sensitive elements having positions corresponding with the range of the second position parameter of the visual representations. The elements are selectively actuatable in response to the timing and element selection signals. An actuated element is selectively responsive to the presence and absence of incident light to generate output signals having either of two possible values.

The typewriter further has visual display means, and display control means connected between the scanner and the visual display means and responsive to the scanner output signals and to a control signal to control the display means to display a visual representation of a character. Further, the typewriter has a printer, a store responsive to the scanner output signals and to a control signal to store the scanner output signals, and printer control means connected between the store and the printer and responsive to a control signal to cause the printer to print a character corresponding to the input numerical signals.

Other objects, features and advantages will appear from the following description of a preferred embodiment, in which.

Figure 1:
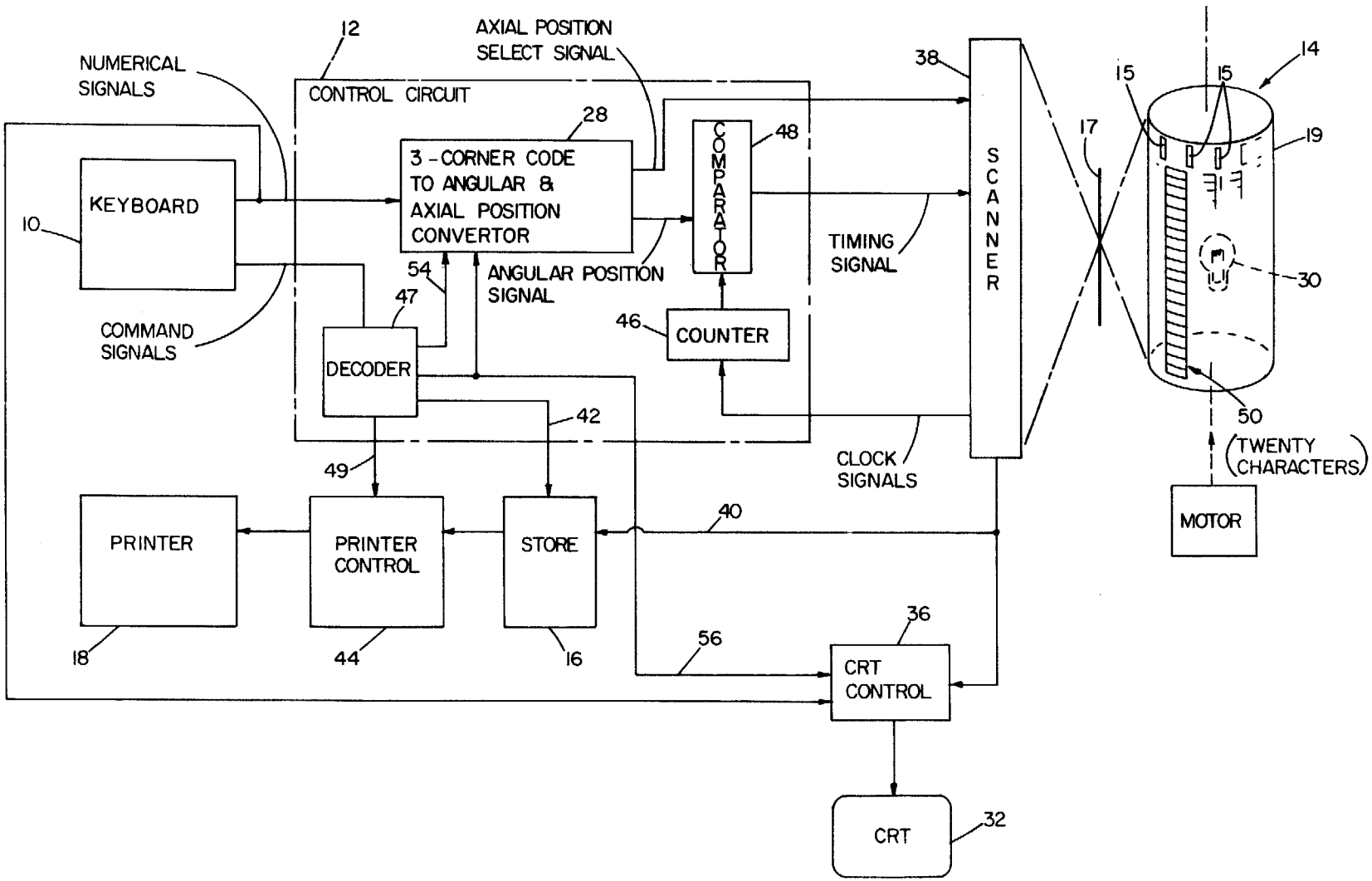
FIG. 1 is a block diagram of the elements of the system of the invention.

Referring to the drawing, and particularly to FIG. 1, the typewriter of the invention comprises generally a keyboard 10 for the input of numerical and command signals, a control circuit 12 for control of the system, a rotating drum 14 carrying a film strip 19 on which are optionally stored a plurality of Chinese characters, a store 16, a CRT display 32, and a printing device 18.

Figure 2:
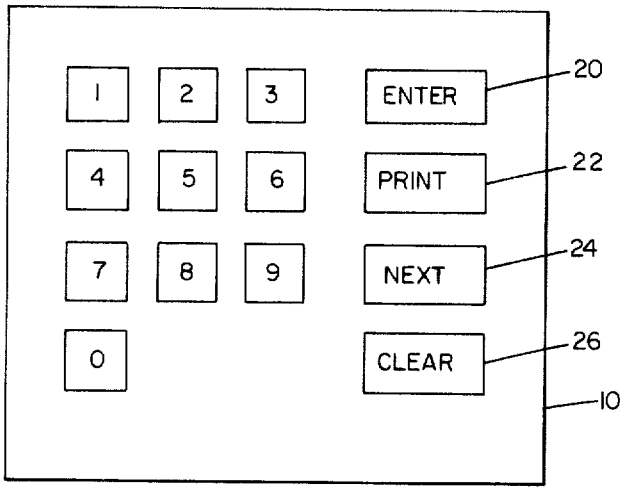
FIG. 2 shows the keyboard of the system of the invention.

Referring to FIG. 2, keyboard 10 provides a group of ten decimal number keys, and four command keys.

The keys of keyboard 10 operate matrix switches which generate input signals in a conventional manner. The signals, representing both numerical values and commands, are input to control circuit 12.

Each input numerical signal is input to control circuit 12, and at the same time is applied directly to the CRT control 36 to cause CRT 32 to display the corresponding digit, together with the other digits comprising the three-corner code as they are input. This provides confirmation to the operator that he has entered the digits he intended.

Of the four command keys, the ENTER key 20 generates a signal which causes a complete input three-corner code, comprising six digits, to be employed to select a character from drum 14 for display on CRT 32, to permit the operator to verify that the desired character has been selected.

The PRINT key 22 generates a signal which is input to control circuit 12 and which results in a selected character being printed.

The NEXT key 24 is employed in the special case in which a three-corner code represents more than one character; if the first character displayed in response to the input three-corner code is not the desired character, the operator pushes NEXT key 20 to cause the next possible character to be displayed.

The CLEAR key 26 is used to clear the display of an input digit or digits.

The optical storage element comprises a continuously rotating drum 14, carrying a band of film 19. Film 19 may store from 8192 to 10,240 characters. In the preferred embodiment, 10,240 characters are stored, and for this purpose the surface of film 19 is divided into 512 angular positions (columns) and 20 axial (linear) positions in each column. That is, there are twenty characters in a column, and there are 512 columns of twenty characters each. A vertical column 50 of twenty characters occupies about 0.60 inch. A clock band is provided around one edge of the film, on which are provided clock marks 15 between character columns. The character columns and clock marks occupy about 315 degrees of the 360 degrees of angular position around the drum. The remaining 45 degrees are blank.

The characters are stored in photographic negative form; the character is transparent, while the area surrounding the character is opaque. Drum 14 is constantly illuminated by an internal light source 30. Light from one column position of drum 14, illuminating a column 50 of twenty characters together with a portion of clock band 13, is focussed through a focussing element 17 upon scanner 38.

Scanner 38 comprises a single vertical array of 1024 light-sensitive elements such as charge coupled diodes (CCD). 1024 elements span one entire column of drum 14. A magnification of about 1.6 times is provided between the character on the film and the CCD array on which the character is imaged. That is, the character on the film is about 0.03 inch high, whereas it is imaged on 48 CCDs occupying about 0.048 inches.

Since there are twenty characters in one column 50, 960 CCD elements are required to image the column. In addition, sixty-four CCD elements are used to scan the clock band, making 1024 CCD elements in the vertical array of scanner 38.

The clock signals from the sixty-four clock CCD elements are input to a counter 46 in logic circuit 12, which is reset to zero when the blank segment of film 19 is scanned. The count of clock marks thus represents rotational position of drum 14. The count is input to a comparator 48, together with the axial position signal derived in converter circuit 28 from the input three-corner code. Comparator 48 generates a timing signal which causes scanner 38 to be activated only when the proper column 50, containing the designated character, is being imaged upon it. The signal representative of the axial position derived from the input three-corner code is employed to select the signals from the elements of scanner 38 on which the selected character on drum 14 is imaged.

The output of each actuated light-sensitive element is binary, that is, either on or off, depending on whether light from source 30 reaches the element through a portion of the character on drum 14 or is obscured by the opaque region surrounding it. The binary output signals from scanner 38 selected by the axial position select signal are input to the CRT control circuit 36, of conventional design, which controls CRT 32 to display the character for verification by the operator. The output signals from scanner 38 are also applied on line 40 to store 16.

Logic circuit 12 includes a decoder 47 which derives from the input command signal from PRINT key 22 a store control signal, which is applied to store 16 on line 42, and controls the storing into store 16 of the character control signals applied on line 40. Character control signals stored in store 16 are applied to printer control circuit 44, which under the control of a signal on line 49 from logic circuit 12, derived from the input command signal from the PRINT key 22, causes printer 18 to print the character. Decoder 47 derives from the CLEAR command signal a signal which is applied on the line 56 to CRT control circuit 36 to clear CRT 32.

Figure 3:
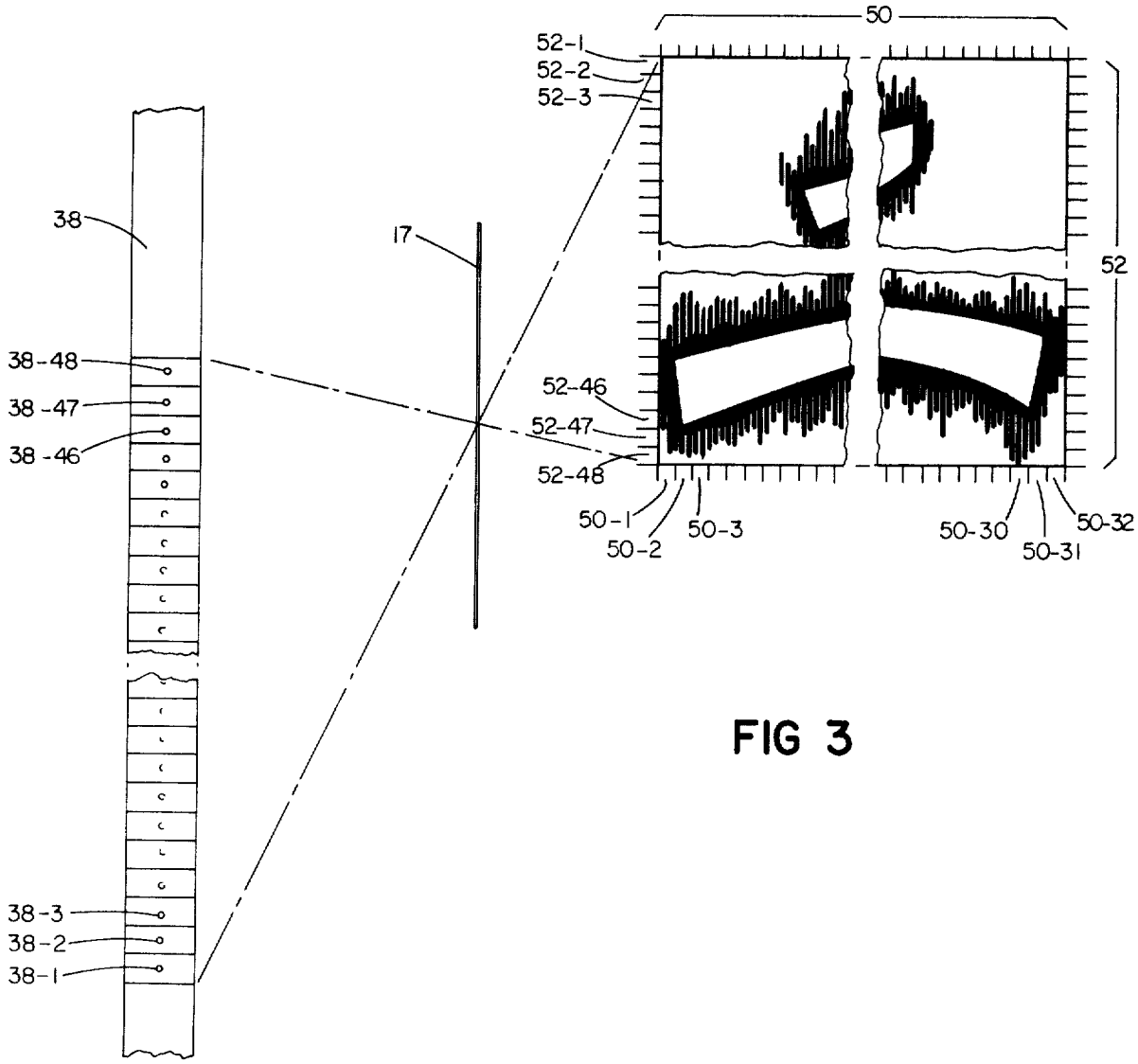
FIG. 3 shows in detail certain portions of FIG. 1.

Referring now to FIG. 3, a portion of the scanner 38 comprises individual light-sensitive elements 38-1, 38-2 through 38-48. A portion of film 19 comprising a single column position 50 and a single axial position 52 is shown. The character appears on the film in analog form, that is, not actually divided into a grid of binary elements. However, as is indicated, the character is scanned in a manner which in effect divides it into a matrix of forty-eight successive axial elements by thirty-two successive column elements (within one column position).

As drum 14 rotates, light from the first column element of the character (containing forty-eight vertically aligned axial elements) is focussed on scanner elements 38-1 through 38-48. (The light is inverted by focussing element 17.) If the light is not obstructed by the opaque background, the corresponding light sensitive element is actuated and generates a signal. If the light is obstructed, the light sensitive element is not actuated. As drum 14 rotates further, light from the next column element (forty-eight axial elements) is focussed on the same scanner elements, and so on through thirty-two column elements.

In operation, the operator of the system inspects a character and by means of the keys on keyboard 10 inputs a six-digit code. After observing on the CRT 32 that the six digits are those he intended to enter, the operator presses ENTER key 20. The six digits are then input to converter circuit 28, and an axial position select signal and an angular position signal are generated. The angular position signal is compared by comparator 48 with the clock mark count from counter 46 to derive a timing signal. In response to the timing signal, scanner 38 is actuated when the particular column position 50 containing the desired character is in a position in which the first of the thirty-two column elements is imaged on scanner 38. The axial position select signal causes the signals from the particular CCD's on which the character is imaged to be selected and applied to the CRT control block 36 and to the store 16. The scanner is actuated thirty-two times as the drum 14 rotates, imaging successive linear arrays of column elements across the character on scanner 38 and generating in effect a matrix of $32 \times 48$ binary signals to represent the character.

If the character displayed on CRT 32 is the desired character, the operator presses PRINT key 22 to cause the signals representing the character to be applied to printer control block 44 and then printed by printer 18. If an incorrect character corresponding to the input code is displayed, the operator presses NEXT key 24. Decoder 47 derives from the NEXT command signal a signal on line 54 which causes converter 28 to generate another pair of angular and axial position signals, corresponding to the location of another character denoted by the input code. This next character is then displayed for the operator to verify.

What is claimed is:

1. An ideographic typewriter comprising:

a keyboard providing keys for generating numerical signals representative of numerical values corresponding to an ideographic character, and command signals representative of operational commands, control means connected to said keyboard for receiving said signals and including decoding means responsive to said command signals for deriving control signals, conversion means for converting said numerical signals corresponding to a said character to signals representative of first and second position parameters, and means for deriving from said second position parameter signal element selection signals, and comparator means for comparing said first position parameter signal with an input first position signal, and for deriving therefrom timing signals, a rotating optical storage device having stored visual representations of characters, a said visual representation of a character comprising character portions and background portions of contrasting light transmission characteristics, each said character representation having first and second position parameters defining its location on said optical storage device, said first position parameter being related to the rotational position of said device, said optical storage device providing to said control means a signal representative of its rotational position, a light source directing light through at least a group of said visual representations having a common value of said first position parameter, a scanner disposed to receive light from an opposed group of said visual representations having a common value of said first position parameter, said scanner comprising a plurality of light-sensitive elements having positions corresponding with the range of said second position parameter of said visual representations, said elements being selectively actuatable in response to said timing and element selection signals, an actuated said element being selectively responsive to the presence and absence of incident light to generate output signals having either of two possible values, visual display means, display control means connected between said scanner and said visual display means and responsive to said scanner output signals and to a said control signal to control said display means to display a visual representation of a character, a store responsive to said scanner output signals and to a said control signal to store said scanner output signals, a printer, and printer control means connected between said store and said printer and responsive to a said control signal to cause said printer to print a character corresponding to said input numerical signals.

* * * * *